US009615655B1

(12) United States Patent
Huang

(10) Patent No.: US 9,615,655 B1
(45) Date of Patent: Apr. 11, 2017

(54) LIFTING MECHANISM FOR DESK

(71) Applicant: Ming-Hsien Huang, New Taipei (TW)

(72) Inventor: Ming-Hsien Huang, New Taipei (TW)

( * ) Notice: Subject to any disclaimer, the term of this patent is extended or adjusted under 35 U.S.C. 154(b) by 0 days.

(21) Appl. No.: 15/133,833

(22) Filed: Apr. 20, 2016

(30) Foreign Application Priority Data

Oct. 15, 2015 (TW) ..... 104216486

(51) Int. Cl.
*A47B 9/00* (2006.01)
*A47B 9/16* (2006.01)
*A47B 21/02* (2006.01)
*A47B 9/02* (2006.01)

(52) U.S. Cl.
CPC ..... *A47B 9/16* (2013.01); *A47B 9/02* (2013.01); *A47B 21/02* (2013.01)

(58) Field of Classification Search
CPC ..... A47B 9/16; A47B 9/02; A47B 21/02
See application file for complete search history.

(56) References Cited

U.S. PATENT DOCUMENTS 2,641,247 A * 6/1953 Genebach ..... F24C 15/16 108/116
4,032,103 A * 6/1977 Ehrichs ..... D06F 81/04 248/421
4,249,749 A * 2/1981 Collier ..... B62B 1/00 108/145
4,685,731 A * 8/1987 Migut ..... B60N 2/164 108/147
6,701,853 B1 * 3/2004 Hwang ..... A47B 3/02 108/118
7,677,518 B2 3/2010 Chouinard et al.
7,849,789 B1 * 12/2010 Whelan ..... A22C 17/0013 108/116
8,015,638 B2 * 9/2011 Shimada ..... A47C 19/04 108/145
8,544,391 B2 * 10/2013 Knox ..... B60N 3/063 108/12
9,049,923 B1 * 6/2015 Delagey ..... A47B 9/18
9,055,810 B2 6/2015 Flaherty
9,326,598 B1 * 5/2016 West ..... A47B 3/02
2013/0139736 A1 * 6/2013 Flaherty ..... A47B 9/18 108/106
2015/0250303 A1 9/2015 Flaherty
2016/0249737 A1 * 9/2016 Han ..... B60P 3/34

* cited by examiner

*Primary Examiner* — Daniel Rohrhoff
(74) *Attorney, Agent, or Firm* — Muncy, Geissler, Olds & Lowe, P.C.

(57) ABSTRACT

A lifting mechanism for desk including a first bracket, a second bracket, and at least one cross-arm assembly is provided. The cross-arm assembly has at least three connecting ends for connecting the first bracket and the second bracket respectively. The cross-arm assembly rotates about a first axis to change a shear angle thereof, and drives the first and the second brackets to move close to or away from each other relatively in a second axis.

19 Claims, 19 Drawing Sheets

LIFTING MECHANISM FOR DESK

This application claims the priority benefit of Taiwan application serial no. 104216486, filed on Oct. 15, 2015. The entirety of the above-mentioned patent application is hereby incorporated by reference herein and made a part of this specification.

CROSS-REFERENCES TO RELATED APPLICATIONS

Not applicable.

BACKGROUND OF THE INVENTION

Field of the Invention

The invention is related to a lifting mechanism, and particularly to a lifting mechanism for desk.

Descriptions of the Related Art

At many work places, people have to spend a lot of their working hours sitting for work. To avoid possible injuries and pains resulting from sustained sitting times, current techniques make it possible to manufacture various desks for standing use. However, although standing at work allows people to feel more energetic and boosts consumption of calories, it also increases burden to the human circulatory system and is more tiring. Meanwhile, standing at work may also increase risks of carotid atherosclerosis or varices. In other words, standing for long hours at work is not a solution that can solve the problems brought by long sitting time.

Therefore, it is necessary to find a solution that can retain the advantages of standing and sitting at work so people do not have to maintain a fixed posture for work while achieving productivity without worrying about injuries and pains resulting from long standing and sitting time.

SUMMARY OF THE INVENTION

The invention provides a lifting mechanism for desk, and a desk body thereof is liftable via a cross-arm assembly so users can carry out work at the desk with different heights.

In the invention, the lifting mechanism for desk includes a first bracket, a second bracket and at least one cross-arm assembly. The cross-arm assembly has at least three connecting ends for connecting the first bracket and the second bracket respectively. The cross-arm assembly rotates about a first axis to change a shear angle thereof, and drives the first and the second brackets to move close to or away from each other relatively along a second axis.

In an embodiment of the invention, at least two of the connecting ends are slidably coupled to the first bracket, the second bracket, or the first bracket and the second bracket.

In an embodiment of the invention, at least one of the connecting ends is only pivoted to the first bracket or the second bracket.

In an embodiment of the invention, the mechanism further includes a desk body assembled to the first bracket.

In an embodiment of the invention, the cross-arm assembly includes a first shaft and a second shaft. The first shaft has a first connecting end and a second connecting end. The first connecting end is pivoted to the first bracket, and the second connecting end is slidably coupled to the second bracket along a third axis. The second shaft has a third connecting end and a fourth connecting end. The third connecting end is pivoted to the second bracket, and the fourth connecting end is slidably coupled to the first bracket along the third axis. The first axis, the second axis, and the third axis are orthogonal to one another.

In an embodiment of the invention, the lifting mechanism for desk further includes a pivoting component pivoted between the first shaft and the second shaft.

In an embodiment of the invention, the first shaft further includes a sliding slot. An extending direction of the sliding slot is consistent with an extending direction of the first shaft. One side of the pivoting component is pivoted to the second shaft. The other side of the pivoting component is slidably and rotatably coupled to the sliding slot.

In an embodiment of the invention, the lifting mechanism for desk further includes a first rail assembly and a second rail assembly. The first rail assembly includes a first rail and a first sliding component. The first sliding component is slidably coupled to the first rail. The first rail is disposed on the first bracket along the third axis. The fourth connecting end is connected to the first sliding component. The second rail assembly includes a second rail and a second sliding component. The second sliding component is slidably coupled to the second rail. The second rail is disposed on the second bracket along the third axis. The second connecting end is connected to the second sliding component.

In an embodiment of the invention, the first sliding component or the second sliding component further includes an engaging flange. The lifting mechanism for desk further includes a positioning component and a stirring component. The positioning component includes a pivoting end, a forcing end, and a plurality of positioning slots between the pivoting end and the forcing end. The pivoting end is pivoted to the first bracket or the second bracket, such that the positioning slots are located adjacent to a sliding path of the first sliding component or a sliding path of the second sliding component. The stirring component is pivoted to the first bracket or the second bracket. The stirring component has a protruding rod that is movably extended to the forcing end. The stirring component is adaptable for being driven by an external force such that the protruding rod pushes the forcing end so that the positioning component rotates with respect to the first bracket or the second bracket, and the engaging flange is engaged in one of the positioning slots.

In an embodiment of the invention, the lifting mechanism for desk further includes an elastic component abutted between the first bracket and the positioning component, or abutted between the second bracket and the positioning component. The elastic component constantly drives the positioning component to be engaged with the engaging flange, or the elastic component constantly drives the positioning component to be away from the engaging flange.

In an embodiment of the invention, the lifting mechanism for desk further includes a torsion spring that is disposed at a position where the first connecting end is pivoted to the first bracket and abutted between the first shaft and the first bracket, or disposed at a position where the third connecting end is pivoted to the second bracket and abutted between the second shaft and the second bracket so as to drive the first shaft to rotate with respect to the first bracket, or drive the second shaft to rotate with respect to the second bracket.

In an embodiment of the invention, a length of orthogonal projection of the first shaft and a length of orthogonal projection of the second shaft on a plane are equal to each other. Meanwhile, the pivoting component is pivoted to a middle position of the first shaft and a middle position of the second shaft, wherein the first axis is along a normal vector of the plane.

In an embodiment of the invention, the cross-arm assembly includes a third shaft, a fourth shaft, and a pivoting component. The third shaft includes a fifth connecting end and a sixth connecting end. The fifth connecting end is pivoted to the first bracket. The sixth connecting end is slidably coupled to the second bracket along the third axis. The first axis, the second axis, and the third axis are orthogonal to one another. The fourth shaft includes a seventh connecting end pivoted to the second bracket. The pivoting component is pivoted to the third shaft and fourth shaft on the first axis.

In an embodiment of the invention, the lifting mechanism for desk further includes a third rail assembly, including a third rail and a third sliding component. The third rail is disposed on the first bracket along the third axis. The third sliding component is slidably coupled to the third rail, and the sixth connecting end is connected to the third sliding component.

In an embodiment of the invention, the lifting mechanism for desk includes a pair of cross-arm assemblies and at least one beam. The cross-arm assemblies are respectively disposed between the first bracket and the second bracket. The beam is connected to the cross-arm assemblies therebetween.

In an embodiment of the invention, the cross-arm assembly includes a first shaft and a second shaft. The first shaft includes a first connecting end and a second connecting end. The first connecting end is slidably connected to the first bracket along the third axis. The second connecting end is slidably connected to the second bracket along the third axis. The second shaft includes a third connecting end and a fourth connecting end. The third connecting end is pivoted to the second bracket. The fourth connecting end is pivoted to the first bracket. The first axis, the second axis, and the third axis are orthogonal to one another.

In an embodiment of the invention, the first bracket includes a first edge and a second edge on the opposite sides of the cross-arm assembly. The second bracket includes a third edge and a fourth edge on the opposite sides of the cross-arm assembly. The first edge and the third edge are located on the same side of the cross-arm assembly. The second edge and the fourth edge are located on the other same side of the cross-arm assembly. The third connecting end is pivoted to the second edge and the third edge such that the first bracket and the second bracket move relatively along the third axis while moving relatively along the second axis.

In an embodiment of the invention, the cross-arm assembly includes a first shaft and a second shaft. The first shaft includes a first connecting end and a second connecting end. The first connecting end is slidably coupled to the first bracket along a third axis. The second connecting end is slidably coupled to the second bracket along the third axis. The second shaft includes a third connecting end and a fourth connecting end. The third connecting end is pivoted to the second bracket. The fourth connecting end is slidably coupled to the first bracket along the third axis. The first axis, the second axis, and the third axis are orthogonal to one another.

In an embodiment of the invention, the cross-arm assembly includes a first shaft and a second shaft. The first shaft includes a first connecting end and a second connecting end that are respectively slidably coupled to the first bracket and the second bracket along the third axis. The second shaft includes a third connecting end and a fourth connecting end that are respectively slidably coupled to the first bracket and the second bracket along the third axis. The first axis, the second axis, and the third axis are orthogonal to one another.

Based on the above, the lifting mechanism for desk disposes at least one cross-arm assembly between two brackets so that the four connecting ends of the cross-arm assembly are pivoted to or slidably disposed on the two brackets. Accordingly, when the cross-arm assembly performs a shearing action, the two brackets can be driven to move relatively close to or away from each other so as to adjust the relative distance between the two brackets.

In other words, the desk body can ascend/descend along with the change of relative distance between the two brackets, such that the user can adjust the distance (i.e. the height of the desk body) depending on the need and switch between sitting posture and standing posture. Meanwhile, the user can carry on working while changing posture. Accordingly, it is possible to avoid injuries or pains resulting from sitting or standing for a long time while maintaining work productivity, thereby achieving the effect of stay healthy and productive.

In order to make the aforementioned features and advantages of the invention more comprehensible, embodiments accompanying figures are described in detail below.

DESCRIPTION OF THE PREFERRED EMBODIMENT

Figure 1:
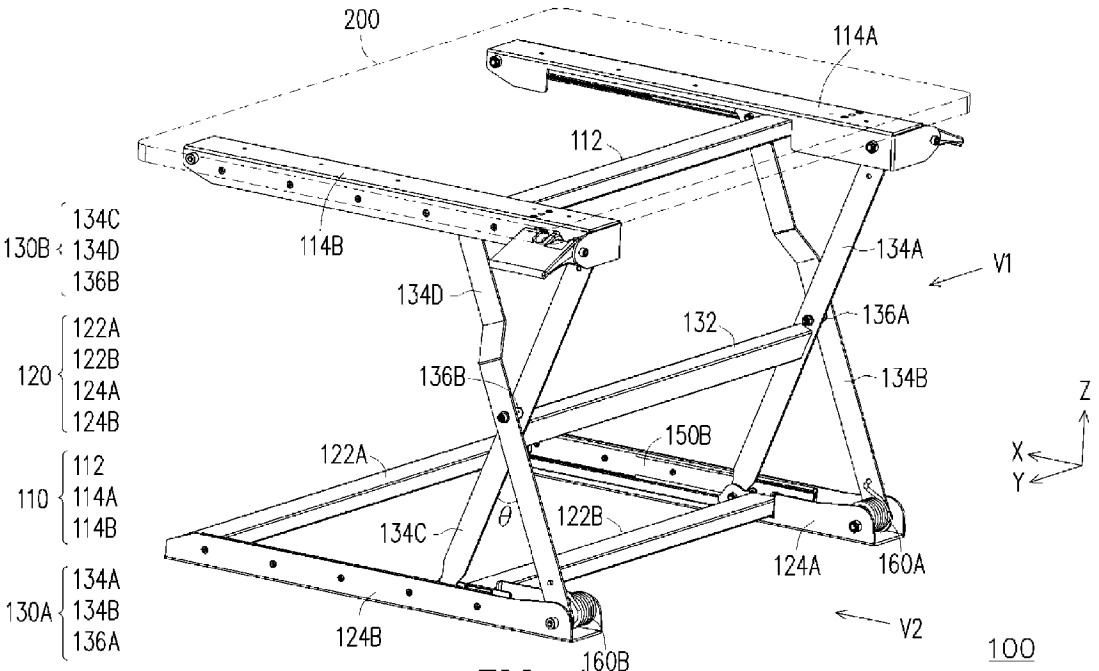
FIG. 1 is a schematic view illustrating a lifting mechanism for desk according to an embodiment of the invention.
Figure 2:
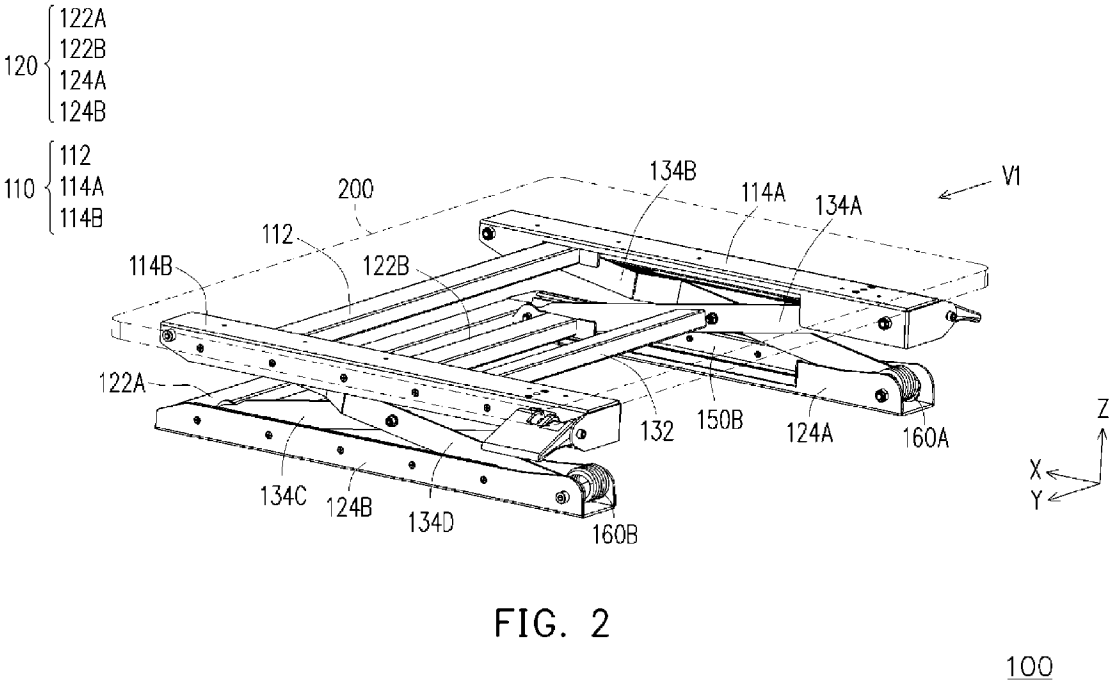
FIG. 2 is a schematic view illustrating another state of the lifting mechanism for desk.
Figure 3:
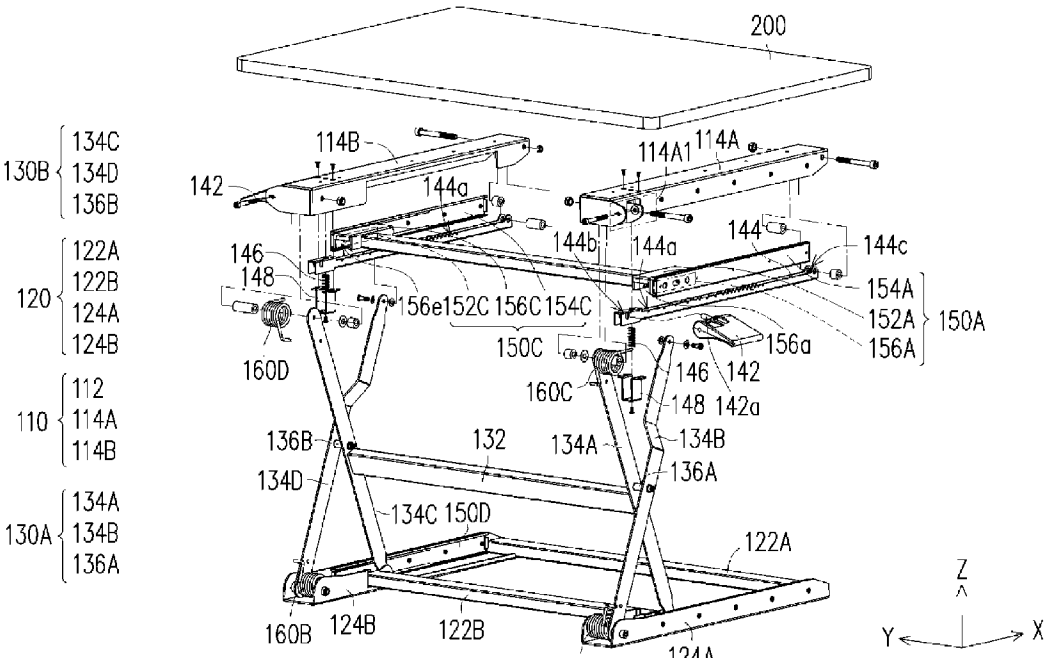
FIGS. 3 and 4 are respectively explosive views of the lifting mechanism for desk shown by FIG. 1.
Figure 4:
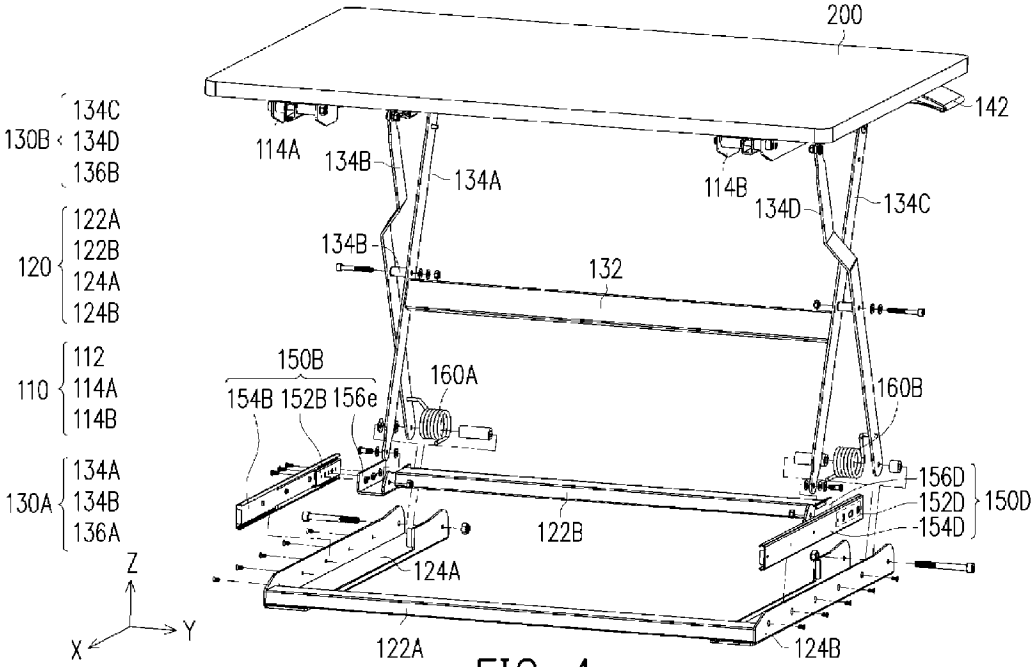

FIG. 1 is a schematic view illustrating a lifting mechanism for desk according to an embodiment of the invention, which shows an open state of the mechanism when a desk body ascends. FIG. 2 is a schematic view illustrating another state of the lifting mechanism for desk shown by FIG. 1, which shows a closing state of the mechanism when the desk body descends. FIGS. 3 and 4 are respectively explosive views illustrating the lifting mechanism for desk shown by FIG. 1. Since there are many components, the schematic views are illustrated separately so that FIG. 3 can clearly show the components in the upper half part of the lifting mechanism for desk, and FIG. 4 can clearly show the components in the lower half part of the lifting mechanism for desk. Referring to FIGS. 1 to 4, in the embodiment, a lifting mechanism 100 for desk includes a first bracket 110, a second bracket 120 and at least one cross-arm assembly 130A or 130B. A desk body 200 is adapted to be assembled on the first bracket 100. An open/closing movement is able to be achieved between the first bracket 110 and the second bracket 120 through the movement of the cross-arm assembly 130A or 130B, such that the first bracket 110 and the desk body 200 thereon can move with respect to the second bracket 120 via the pivoting movement of the cross-arm assembly 130, enabling the desk body 200 to ascend/descend. In other words, when the second bracket 120 is supported on a platform (not shown, e.g. another desktop), the mechanism makes the desk body 200 to ascend/descend with respect to the platform such that users can carry out work on the desktop with different postures (e.g. standing or sitting). For ease of presentation, the views are illustrated with an X-axis, a Y-axis and a Z-axis defined by a three-dimensional stereo coordination. It should be noted that the cross-arm assembly of the invention substantially includes at least three connecting ends to be respectively connected to the first bracket 110 and the second bracket 120, wherein at least two of the connecting ends are slidably coupled to the first bracket 110, the second bracket 120, or the first bracket 110 and the second bracket 120. At least one connecting end is pivoted to the first bracket 110 or the second bracket 120 only. Different embodiments are incorporated herein for description.

It should be noted that the embodiment is described by using a pair of cross-arm assemblies 130A and 130B that are on the left and right sides of the drawing and respectively disposed on the first bracket 110 and the second bracket 120 as an example. The following descriptions are also provided based on the example. However, in another embodiment that is not shown, the relative movement between the first bracket 110 and the second bracket 120 can be achieved by employing only one cross-arm assembly 130A or 130B. Therefore, no superfluous description is provided in the following embodiments.

In the embodiment, the first bracket 110 includes parts 112, 114A and 114B. The part 112 is horizontally connected between the parts 114A and 114B, forming an H-shape structure, such that the desktop 200 is assembled thereto and leans against the H-shaped structure. Likewise, the second bracket 120 includes parts 122A, 122B, 124A and 124B that are adapted to lean against or be placed on the platform (not shown). Here, the first bracket 110 and the second bracket 120 are mostly the same in terms of structure, but their shape is not limited to the H-shaped structure; for example, they may be formed in a U-shaped configuration.

The cross-arm assembly 130A includes a first shaft 134A, a second shaft 134B, and a pivoting component 136A, wherein the pivoting component 136A is pivoted between the first shaft 134A and the second shaft 134B such that the cross-arm assembly 130A can rotate about the Y-axis. Likewise, the cross-arm assembly 130B on the other side includes a first shaft 134C, a second shaft 134D, and a pivoting component 136B, wherein the pivoting component 136B is pivoted between the first shaft 134C and the second shaft 134D such that the cross-arm assembly 130B can rotate about the Y-axis so as to change a shear angle θ between the first shaft 134A and the second shaft 134B.

Figure 5:
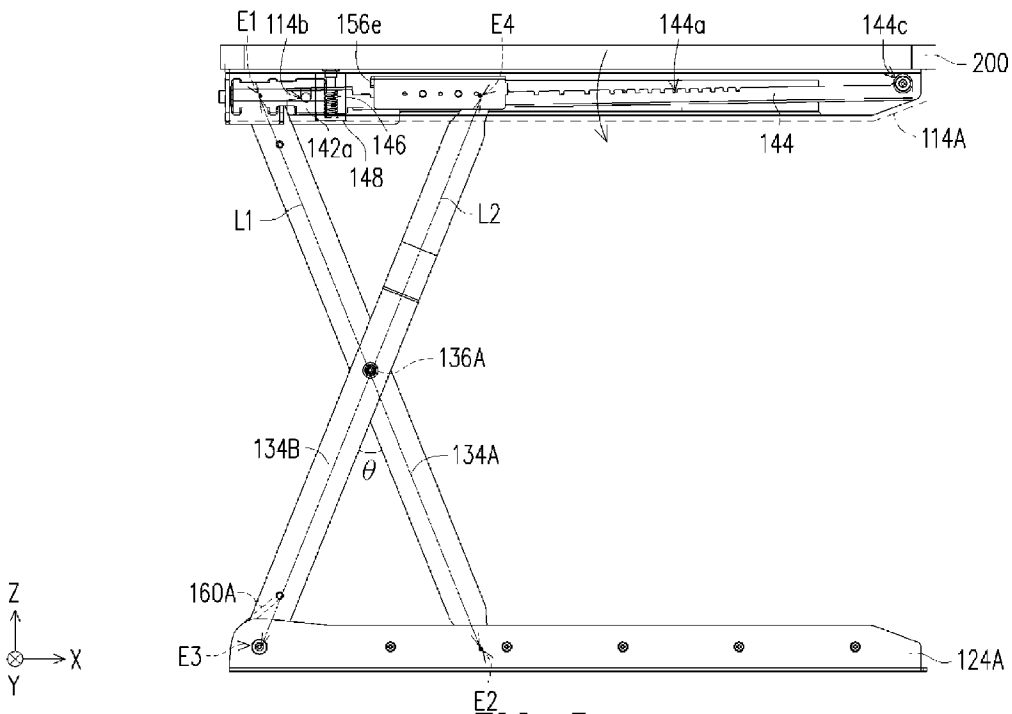
FIGS. 5-7 are schematic views illustrating state change of the lifting mechanism for desk.
Figure 6:
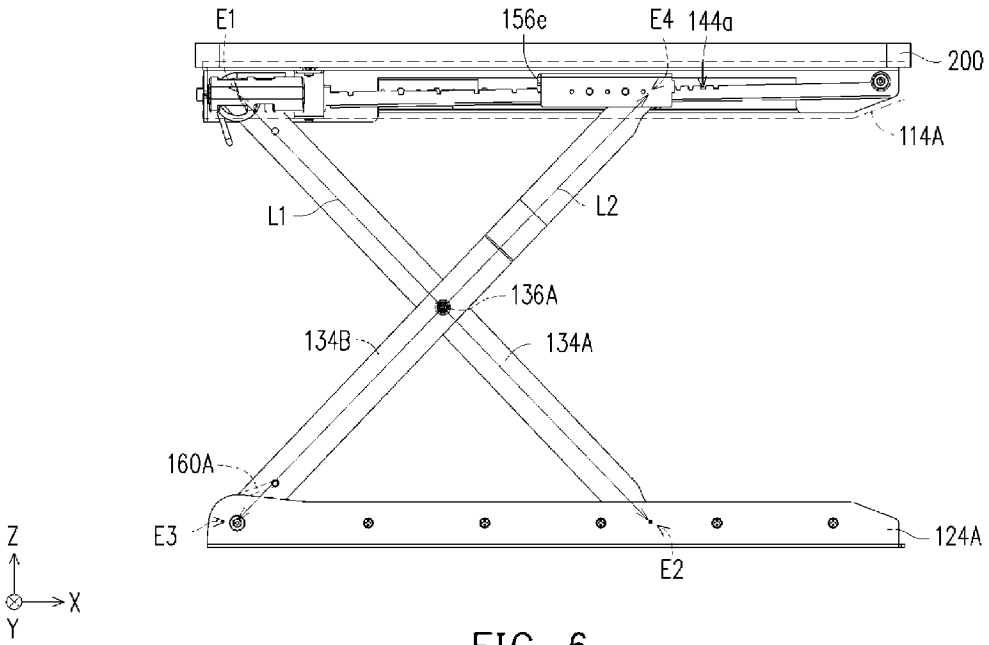
Figure 7:
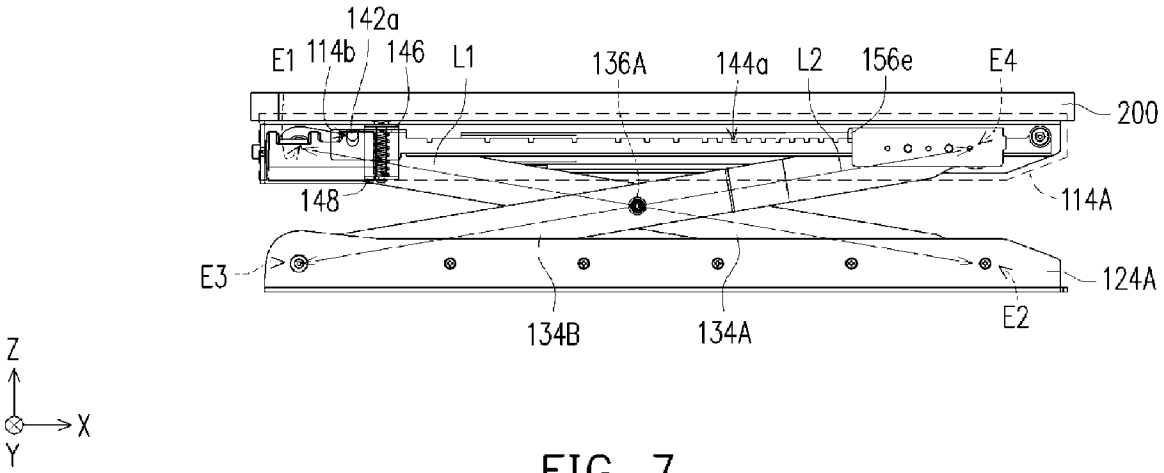

FIGS. 5-7 are schematic views illustrating state change of the lifting mechanism for desk, wherein the cross-arm assembly 130A is illustrated with a viewing angle V1 of FIG. 1. Meanwhile, the cross-arm assembly 130B on the other side also actuates in the same manner without superfluous descriptions herein. The part 114A of the first bracket 110 is illustrated in a perspective view (i.e. outlined with dotted-lines) so as to clearly show the relation of the components at the position. In the embodiment, a beam 132 is horizontally connected between the first shaft 134A and the 134C, such that the two cross-arm assemblies 130A and 130B can actuate simultaneously. Please refer to FIGS. 5-7 first for the descriptions about the actuating mode of the cross-arm assembly 130A.

Here, the first shaft 134A includes a first connecting end E1 and a second connecting end E2. The first connecting end E1 is pivoted to the part 114A of the first bracket 110. The second connecting end E2 is slidably coupled to a part 124A of the second bracket 120. The second shaft 134B includes a third connecting end E3 and a fourth connecting end E4. The third connecting end E3 is pivoted to the part 124A of the second bracket 120. The fourth connecting end E4 is slidably coupled to the part 114A of the first bracket 110.

Accordingly, when the cross-arm assembly 130A (the same also applies to 130B) performs the shearing action, the first shaft 134A, and the second shaft 134B rotate relatively about the pivoting component 136A as the center. Being restricted to the corresponding relation between the shafts and brackets, the second connecting end E2 and fourth connecting end E4 slid along the X-axis due to the rotation action. Meanwhile, the first connecting end E1 and third connecting end E3 rotate with respect to the first bracket 110 and the second bracket 120 (without relative movement). The pivoting component 136A moves along the X-axis (in synchronization with the second connecting end E2 and the fourth connecting end E4), causing the first bracket 110 and second bracket 120 to move close to or away from each other along the Z-axis.

Specifically, further referring to FIGS. 3-4, the lifting mechanism 100 for desk in the embodiment further includes a first rail assembly 150A and a second rail assembly 150B (a first rail assembly 150C and a second rail assembly 150D are relatively disposed on the other side). It should be indicated that the structures of the first rail assemblies 150A, 150C and the second rail assemblies 150B, 150D are constructed in the same manner. Therefore, the same reference numerals are used to denote related rail components in the following descriptions; meanwhile, the rail components 150A and 150B are employed in the following descriptions to refer to related rail components. Here, the first rail assembly 150A includes a first rail 154A, a slider 152A and a carrier 156A (the same also applies to components 152C, 154C, and 156C), wherein the first slider 152A and carrier 156A may be regarded as a first sliding component in the first rail assembly 150A (i.e. in another embodiment that is not shown, they can be an integrally formed structure). The first rail 154A is disposed in the part 114A of the first bracket 110 along the X-axis. The fourth connecting end E4 of the second shaft 134B is connected to the carrier 156A of the first sliding component and further assembled with the first slider 152A so as to slide along the X-axis. The second rail assembly 150B also has the same structure. The difference is that the second rail 154B is disposed in the part 124A of the second bracket 120 along the X-axis, and the second end E2 of the first shaft 134A is connected to the carrier 156B of the sliding component and further assembled with a second slider 152B of the sliding component so as to slide along the X-axis (the same also applies to components 152D, 154D, and 156D).

In addition, the lifting mechanism 100 for desk further includes torsion springs 160A, 160B, 160C and 160D respectively disposed in the first bracket 110 and second bracket 120 and serve to be abutted between the cross-arm assemblies 130A, 130B and the first bracket 110 or second bracket 120. The torsion springs 160A-160D serve as a source of power for the cross-arm assemblies 130A and 130B to rotate. For example, the torsion spring 160A is disposed within the part 124A of the second bracket 120 at the third connecting end E3 of the second shaft 134B and abutted between the part 124A and the second shaft 134B. The torsion spring 160B is disposed within the part 124B on the other side of the second bracket 120 to be abutted between the part 124B and the second shaft 134D. The rest of torsion springs 160C and 160D also serve to drive the cross-arm assemblies 130A and 130B to perform the shearing action. However, the embodiment provides no limitation to the direction of driving the cross-arm assemblies 130A and 130B.

Figure 8:
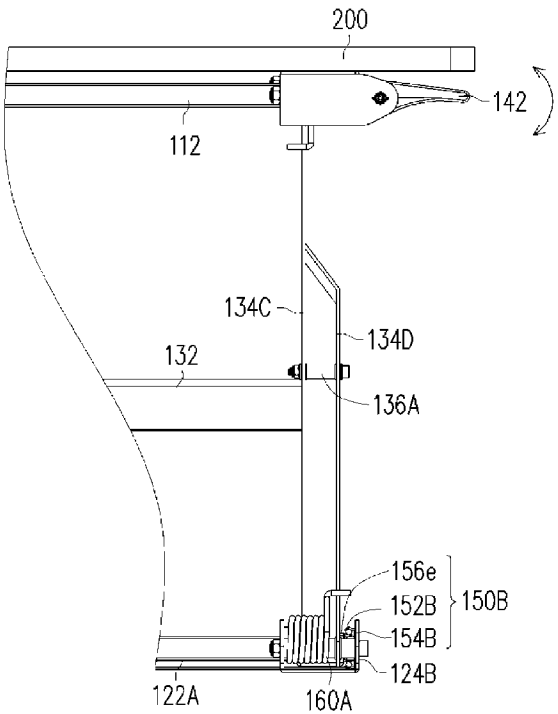
FIG. 8 is a back-side view illustrating a portion of the lifting mechanism for desk shown by FIG. 1.

FIG. 8 is a back-side view illustrating a portion of the lifting mechanism for desk shown by FIG. 1, which is, for example, illustrated with a viewing angle V2 of FIG. 1. Referring to FIGS. 3, 4 and 8, it should be noted that the lifting mechanism 100 for desk further includes a positioning assembly consisting of a positioning component 144, a stirring component 142 and an elastic component 146. As shown in FIGS. 3-4, the lifting mechanism 100 for desk includes two sets of positioning assemblies respectively disposed on the opposite sides of the first bracket 110. The following embodiment is described with only one set of the positioning assembly. In the embodiment, the positioning component 144 includes a pivoting end 144*c*, a forcing end 144*b* and a plurality of positioning slots 144*a* between the pivoting end 144*c* and the forcing end 144*b*. The pivoting end 144*c* is pivoted to the part 114A of the first bracket 110, and the positioning component 144 is disposed along the part 114A (that is, both of the part 114A and the positioning component 144 extending along the X-axis), such that the plurality of positioning slots 144*a* are located next to the sliding path of the first slider 152A and the carrier 156A of the first sliding component. The stirring component 142 is pivoted to the part 114A of the first bracket 110 along the X-axis. As shown in FIG. 3, the part 114A further includes a pivoting plate structure 114A1 extending laterally. The stirring component 142 is substantially pivoted in the pivoting plate structure 114A1 of the part 114A, and the stirring component 142 includes a protruding rod 142*a* that movably extends to the forcing end 144*b*. As the drawing shows, the forcing end 144*b* is formed with a recessed profile such that the protruding rod 142*a* can insert in and stir the positioning component 144. More specifically, the stirring component 142 is adapted to be driven by an external force such that the protruding rod 142*a* can push the forcing end 144*b* so that the positioning component 144 rotates with respect to the part 114A of the first bracket 110 via the pivoting end 144*c*.

Further referring to FIGS. 5-7, correspondingly, the carrier 156A of the first sliding component further includes an engaging flange 156*e*, which, for example, is a bending structure of the edge of the carrier 156A. Also, the lifting mechanism 100 for desk further includes an abutting part 148 assembled to the part 114A for accommodating the elastic component 146. The forcing end 144*b* of the positioning component 144 is also accommodated in the abutting part 148. In other words, the elastic component 146 is disposed to be abutted between the abutting part 148 and the forcing end 144*b* of the positioning component 144. With such configuration, the elastic component 146 can drive the positioning component 144 to rotate via the elastic force; that is, the forcing end 144*b* is driven by the protruding rod 142*a* and the elastic component 146 to change its position.

For example, in the state shown in FIG. 5, the user applies a force to the stirring component 142 such that the positioning component 144 rotates in the manner as shown by the arc-shaped arrow in FIG. 5, so that the engaging flange 156*e* is separated from the positioning slot 144*a*. At this time, the user can apply a force (via the first bracket 110) to the cross-arm assemblies 130A and 130B, for example, by applying a downward force so that the first bracket 110 moves close toward the second bracket 120. As shown in FIG. 6, the elastic component 146 is compressed by the force. Next, when the first bracket 110 moves to the position shown in FIG. 7, the user removes the force applied to the stirring component 142. Accordingly, the elastic force of the elastic component 146 drives the positioning component 144 to rotate in the manner shown by the arc-shaped arrow in FIG. 7 to be restored, such that the engaging flange 156*e* is engaged in another positioning slot 144*a*. The elastic component 146 in the embodiment constantly drives the positioning component 144 to be engaged with the engaging flange 156*e*. The invention provides no limitation to the configuration and distance of the positioning slots 144*a*; the positioning slots 144*a* are provided where necessary depending on the need.

In another embodiment that is not shown, the elastic component can constantly drive the positioning component and the engaging flange to be away from each other via the stretching and deforming characteristics.

Further referring to FIGS. 5-7, it should be indicated that in the embodiment, the first shaft 134A, and the second shaft 134B actually have equivalent lengths. That is, the lengths of orthogonal projections of the first shaft 134A and the second shaft 134B on an X-Z plane are equivalent, i.e. the lengths L1 and L2 (L1=L2) in the drawings. Moreover, the pivoting component 136A is pivoted at the middle position of the first shaft 134A and the middle position of the second shaft 134B, that is, the positions at (L1)/2 and (L2)/2. Accordingly, the first bracket 110 can ascend/descend with respect to the second bracket 120 along the Z-axis only. In other words, in the lifting mechanism 100 for desk of the embodiment, the first bracket 110 and the second bracket 120 ascend/descend in a straight manner along the Z-axis in parallel with the X-Y plane, which means that the desk body 200 of the embodiment actuates in the manner of ascending/descending straight.

Figure 9:
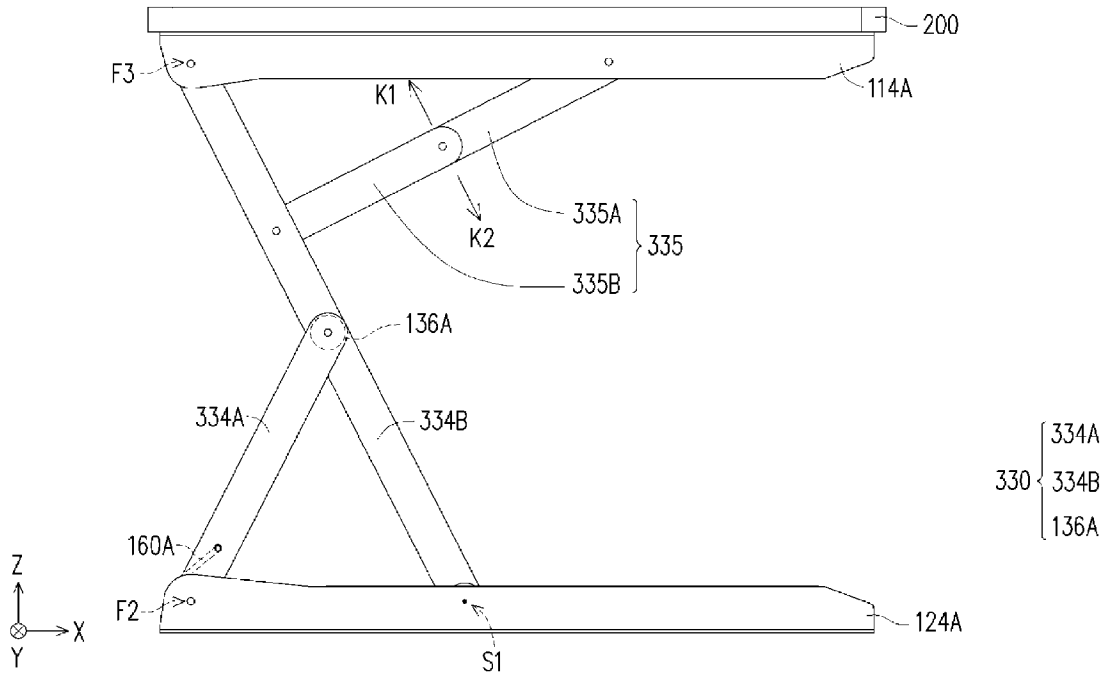
FIG. 9 is a side view illustrating a lifting mechanism for desk according to another embodiment of the invention.

FIG. 9 is a side view illustrating a lifting mechanism for desk according to another embodiment of the invention. Referring to FIG. 9, the embodiment is different from the previous embodiment in that a cross-arm assembly 330 has fixing ends F2 and F3 as well as a sliding end S1. Here, there is only a pivoting relation between the shaft and bracket at the fixing end without relative sliding movement. However, at the sliding end, pivoting and sliding relations simultaneously exist between the shaft and the bracket.

Furthermore, the cross-arm assembly 330 is assembled by a third shaft 334B, a fourth shaft 334A, and a pivoting component 136A. Like the first shaft 134A or 134C, the third shaft 334B has a fifth connecting end and a sixth connecting end (here, the ends of the shaft is named in sequence to be differentiated from that in the previous embodiment), i.e. the fixing end F3 and the sliding end S1 described in the previous embodiment. The fixing end F3 is pivoted to the part 114A, and the sliding end S1 is slidably coupled to the part 124A. The fourth shaft 334A has a seventh connecting end and an eighth connecting end, wherein the seventh connecting end is the previously described fixing end F2 which is pivoted to the part 124A. The eighth connecting end of the fourth shaft 334A is pivoted to the middle position of the third shaft 334B with the Y-axis via the pivoting component 136A. In other words, the fourth shaft 334A of the embodiment has a substantial length that is half of the third shaft 334B and is not connected to the first bracket 110. In other words, the embodiment only needs to dispose a rail assembly (which has an equivalent structure as the rail assembly described in the previous embodiment, no repetition is provided herein) at the part 124A of the second bracket so as for the sliding end S1 (i.e. the previously described sixth connecting end) of the third shaft 334B to be connected to the sliding component of the rail assembly.

Moreover, the embodiment also includes a folding arm 335, having a first segment 335A pivoted to the part 114A, and a second segment 335B pivoted to the third shaft 334B. Meanwhile, the first segment 335A and the second segment 335B are pivoted to each other, such that the folding arm 335 can pivot with respect to the part 114A and the third shaft 334B respectively. The first segment 335A and the second segment 335B can pivot with respect to each other so that a folding effect can be achieved. Meanwhile, the folding arm 335 can also serve a supporting function for the part 114A (of the first bracket) and the desk body 200 thereon.

It should be noted that there is also a stopping portion (not shown) disposed at the position where the first segment 335A and the second segment 335B pivoted to each other. The stopping portion keeps the folding arm 335 to be in a straight state when the folding arm 335 is opened as shown in FIG. 7 without over pivoting. For example, when the folding arm 335 is foldable in a direction K1, the stopping portion prevents the folding arm 335 from keeping pivoting toward a direction K2 when the folding arm 335 is opened as shown in FIG. 7. On the other hand, when the folding arm 335 is foldable along the direction K2, the stopping portion prevents the folding arm 335 from keeping pivoting toward the direction K1 when the folding arm 335 is opened. In particular, the folding arm 335 allows the desk body 200 to be adjusted with a tilt angle, such that the desk body 200 is, for example, approximately parallel with the platform of the desk top. At this time, a locking unit (not shown) disposed on the folding arm 335 is used to fix the tilt angle.

On the other hand, in the embodiments illustrated in FIGS. 1-8, either the cross-arm assembly 130A or the cross-arm assembly 130B is connected to the first bracket 110 and the second bracket 120 via four connecting ends formed by the two shafts. The first connecting end E1 and the third connecting end E3 are respectively pivoted to the first bracket 110 and the second bracket 120 (as shown in FIGS. 5-7). The second connecting end E2 and the fourth connecting end E4 are respectively slidably disposed on the first bracket 110 and the second bracket 120 (i.e. they can also slide with respect to the first bracket 110 and the second bracket 120). The first connecting end E1 and the third connecting end E3 may be regarded as the fixing ends (only a pivoting relation without any sliding relation) positioned on the first bracket 110 and the second bracket 120. The second connecting end E2 and the fourth connecting end E4 may be regarded as the sliding ends (both a sliding relation and a pivoting relation). In other words, in the embodiments illustrated in FIGS. 1-8, the cross-assembly arm 130A or 130B includes two fixing ends and two sliding ends. Moreover, in the embodiment illustrated in FIG. 9, the cross-arm assembly 330 also includes two shafts 334A and 334B. The only difference lies in that the shaft 334A is not connected to the first bracket 110 (the part 114A). Therefore, in the embodiment, the cross-arm assembly 330 substantially includes two fixing ends and one sliding end, and the folding arm 335 forms the fourth connecting end of the cross-arm assembly 330 as a fixing end.

Figure 10:
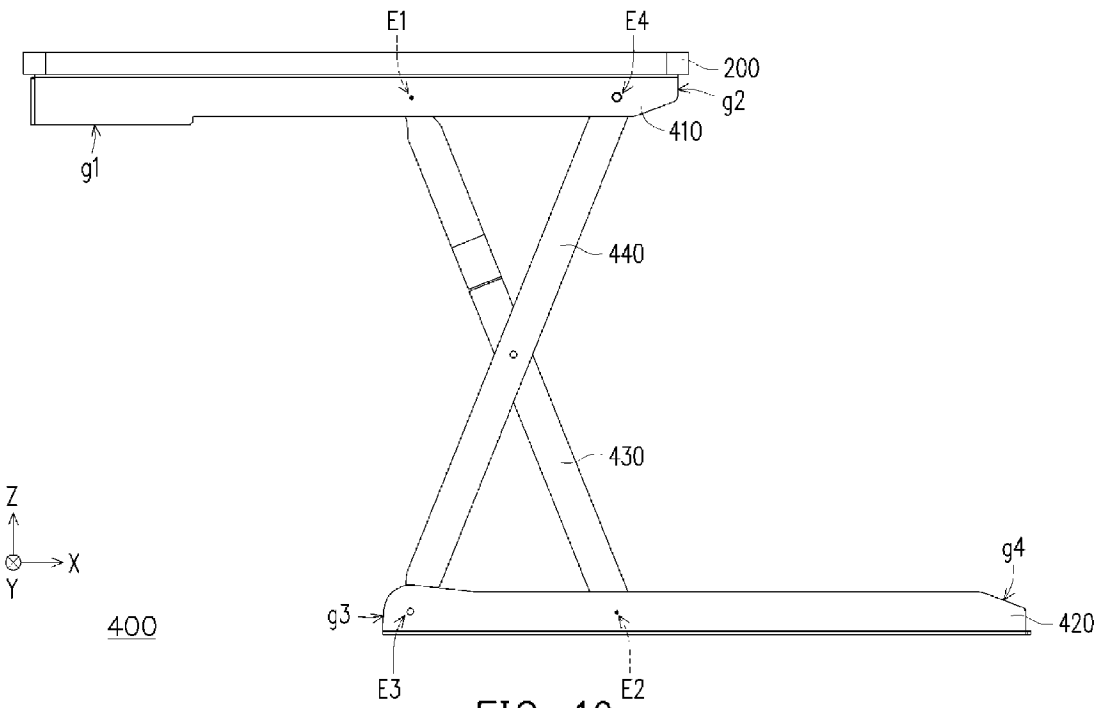
FIGS. 10-12 are schematic views illustrating different states of a lifting mechanism for desk according to another embodiment of the invention.
Figure 11:
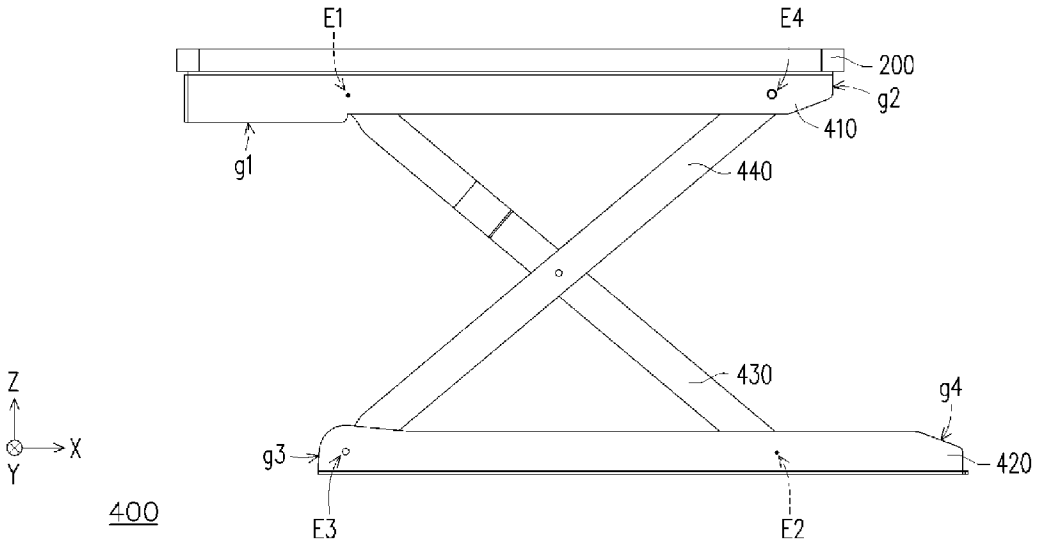
Figure 12:
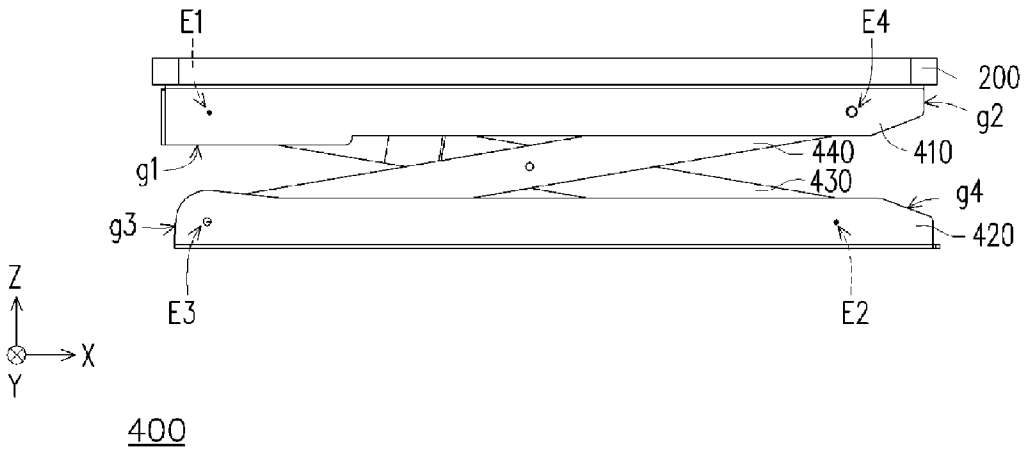

FIGS. 10-12 are schematic views illustrating different states of a lifting mechanism for desk according to another embodiment of the invention. The embodiment is different from the previous embodiments in that, in a lifting mechanism 400 for desk, the cross-arm assembly includes a first shaft 430 having a first connecting end E1 and a second connecting end E2 thereon, and a second shaft 440 having a third connecting end E3 and a fourth connecting end E4 thereon. The first connecting end E1 is slidably connected to a first bracket 410 along the X-axis. The second connecting end E2 is slidably connected to a second bracket 420 along the X-axis. The third connecting end E3 is pivoted to a second bracket 420. The fourth connecting end E4 is pivoted to the first bracket 410. That is to say, the cross-arm assembly of the embodiment includes two fixing ends and two sliding ends.

Specifically, the first bracket 410 has a first edge g1 and a second edge g2 on the opposite sides of the cross-arm assembly. The second bracket 420 has a third edge g3 and a fourth edge g4 on the opposite sides of the cross-arm assembly. The first edge g1 and the third edge g3 are on the same side of the cross-arm assembly. The second edge g2 and the fourth edge g4 are on the other same side of the cross-arm assembly. The third connecting end E3 is connected to the third edge g3. The fourth connecting end E4 is connected to the second edge g2. The first connecting end E1 substantially slides between the first edge g1 and the second edge g2. The second connecting end E2 substantially slides between the third edge g3 and the fourth edge g4. With such configuration, the movement of the cross-arm assembly can cause the first bracket 410 and the second bracket 420 to move with respect to each other along the Z-axis while moving along the X-axis.

Figure 13:
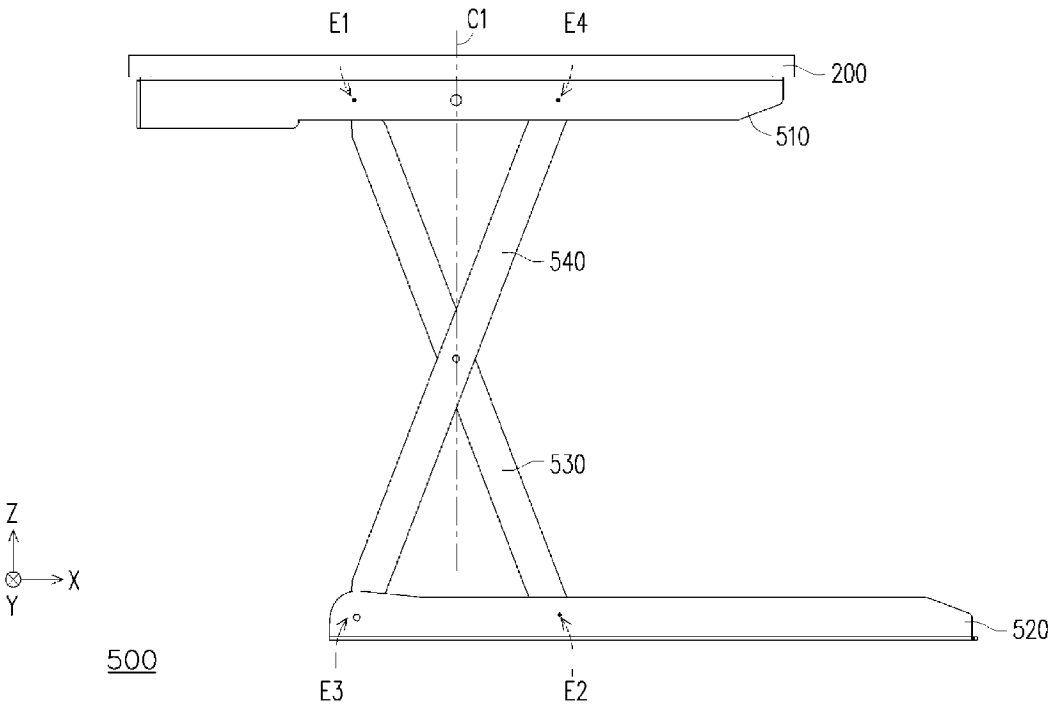
FIGS. 13-15 are schematic views illustrating different states of a lifting mechanism for desk according to another embodiment of the invention.
Figure 14:
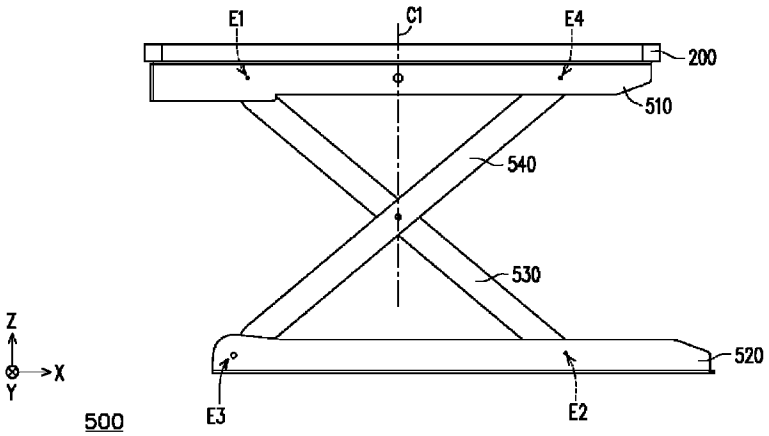
Figure 15:
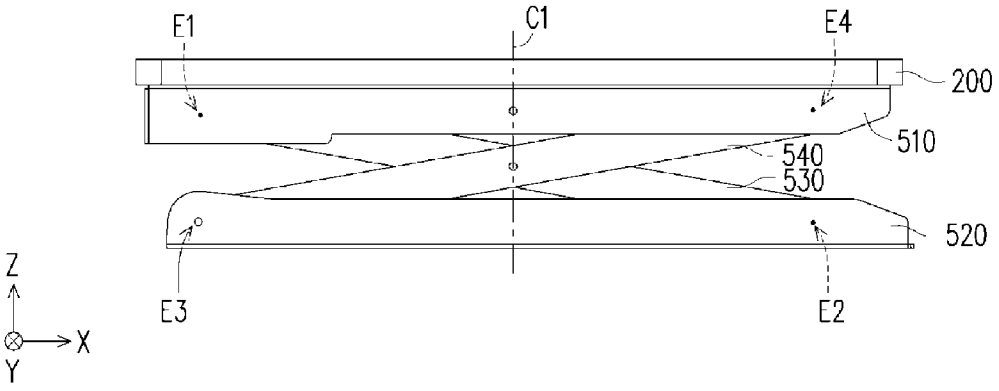

FIGS. 13-15 are schematic views illustrating different states of a lifting mechanism for desk according to another embodiment of the invention. The embodiment is different from the previous embodiments in that, in a lifting mechanism 500 for desk, a first connecting end E1 and a second connecting end E2 of a first shaft 530 are respectively slidably coupled to a first bracket 510 and a second bracket 520 along the X-axis. A third connecting end of a second shaft 540 is pivoted to the second bracket 520, and a fourth connecting end E4 of the second shaft 540 is slidably coupled to the first bracket 510 along the X-axis. Accordingly, the cross-arm assembly of the embodiment substantially includes a fixing end and three sliding ends. Here, since the first connecting end E1 and the fourth connecting end E4 connected to the first bracket 510 are both in a slidable state, in another state that is not shown, the designer may dispose a connecting structure between the beam 132 (please refer to FIG. 1) and the first bracket 510, so that the first bracket 510 and the desk body 200 thereon enable the position where the center of the first bracket 510 crosses the cross-arm assembly to be maintained on a central line C1 during the switching process shown in FIGS. 13-15. In other words, the relative movement stroke between the first bracket 510 and the cross-arm assembly can be fixed.

Figure 16:
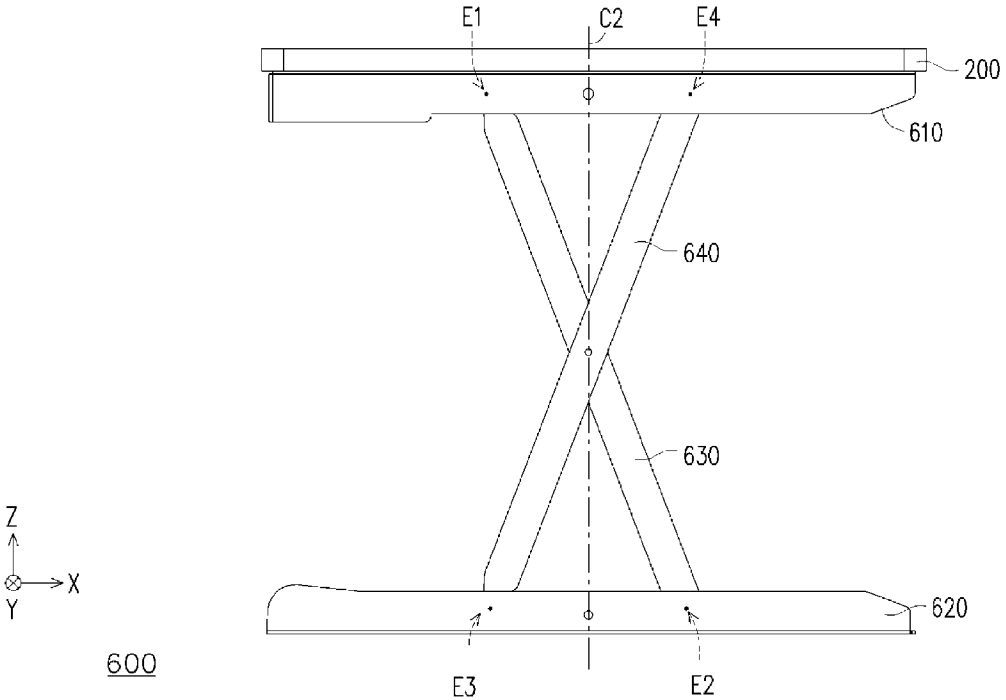
FIGS. 16-18 are schematic views illustrating different states of a lifting mechanism for desk according to another embodiment of the invention.
Figure 17:
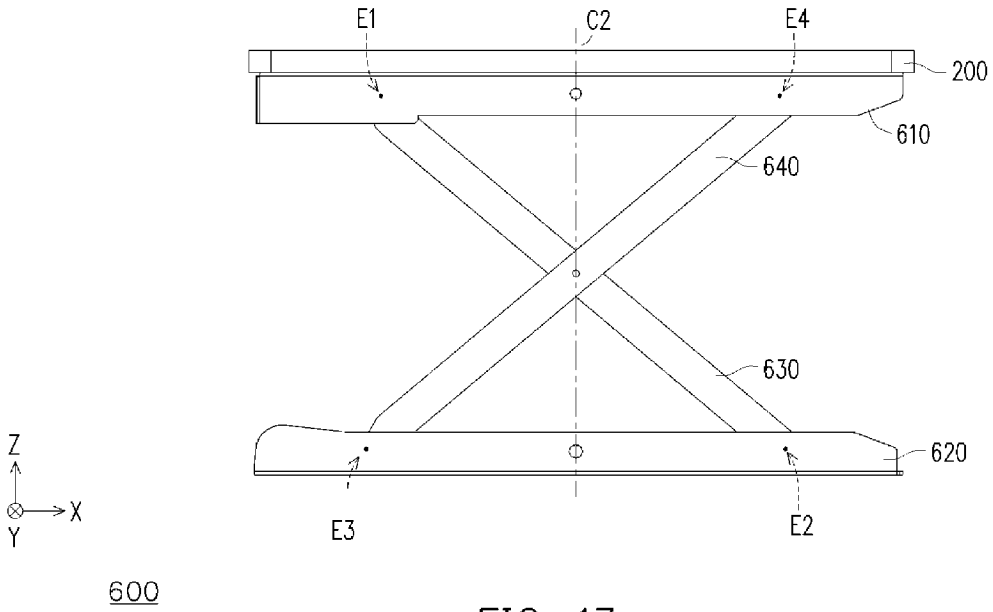
Figure 18:
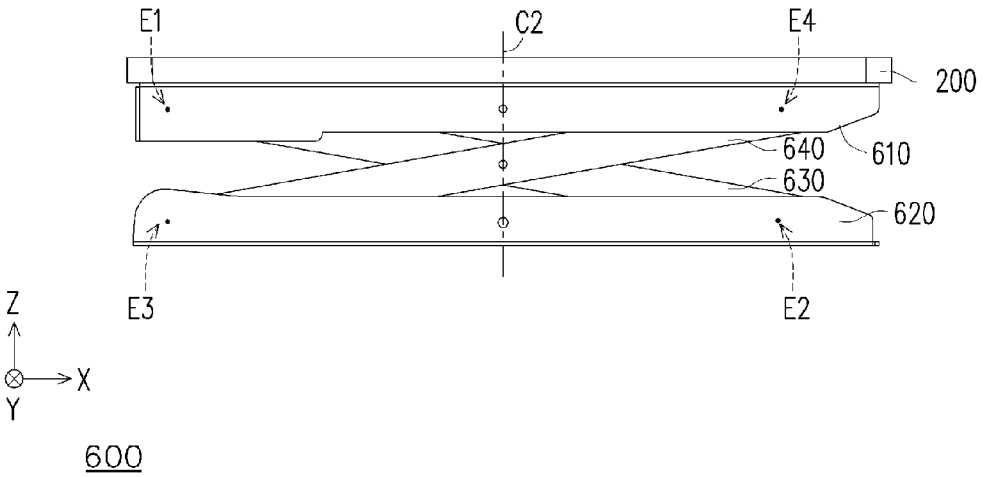

FIGS. 16-18 are schematic views illustrating different states of a lifting mechanism for desk according to another embodiment of the invention. The embodiment is different from the previous embodiments in that, in a lifting mechanism 600 for desk, a first connecting end E1 and a second connecting end E2 of a first shaft 630 as well as a third connecting end E3 and a fourth connecting end E4 of a second shaft 640 are kept in a sliding and pivoting relation with a first bracket 610 and a second bracket 620 respectively. That is to say, the cross-arm assembly of the embodiment substantially includes four sliding ends (without fixing ends). Similar to FIGS. 13-15, to keep the relative movement stroke between the cross-arm assembly and the first bracket 610 as well as the second bracket 620 in consistency, in another state that is not shown, the designer may dispose a connecting structure between the beam 132 and the first bracket 610 as well as the second bracket 620, such that a position where the center of the first bracket 610 and center of the second bracket 620 cross the cross-arm assembly can be maintained on a central line C2.

Figure 19:
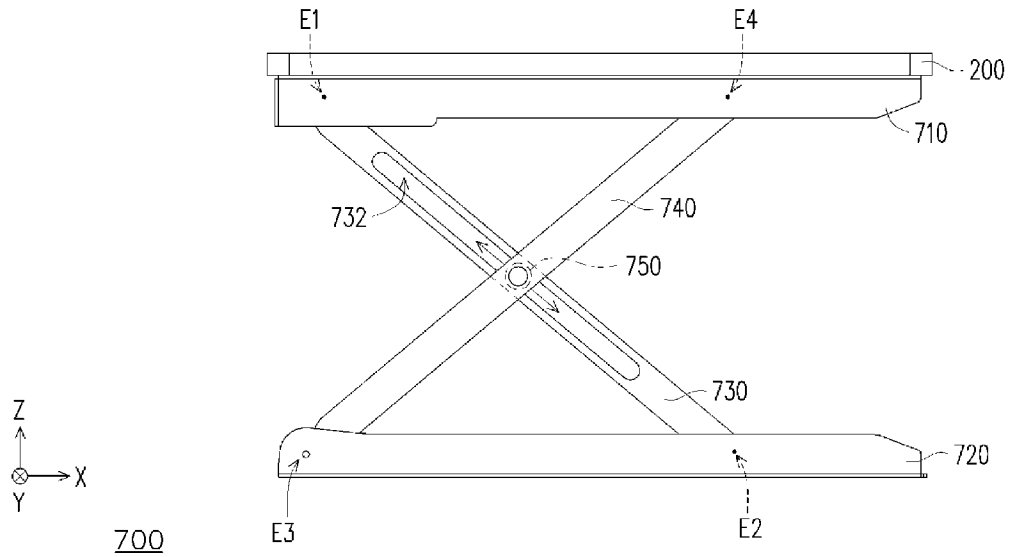
FIG. 19 is a schematic view illustrating a lifting mechanism for desk according to another embodiment of the invention.

FIG. 19 is a schematic view illustrating a lifting mechanism for desk according to another embodiment of the invention. In a lifting mechanism 700 for desk of the embodiment, a first connecting end E1 of a first shaft 730 is pivoted to a first bracket 710, and a second connecting end E2 is slidably coupled to a second bracket 720 along the X-axis. A third connecting end E3 of the second shaft 740 is pivoted to the second bracket 720. A fourth connecting end E4 of the second shaft 740 is slidably coupled to the first bracket 710 along the X-axis. Therefore, in the embodiment, the relative relation between the cross-arm assembly and the first bracket 710 as well as the second bracket 720 is substantially similar to the cross-arm assemblies 130A and 130B. However, the difference between the embodiment and the previous embodiments lies in that the first shaft 730 of the embodiment further includes a sliding slot 732, and an extending direction of the sliding slot 732 is consistent with an extending direction of the first shaft 730. Moreover, the lifting mechanism 700 for desk further includes a pivoting component 750, and one side of the pivoting component 750 is pivoted to the center of the second shaft 740. The other side of the pivoting component 750 is slidably and rotatably coupled to the sliding slot 732. Accordingly, the pivoting component 750 can change the tilt angle of the first bracket 710 (and the desk body 200 thereon) with respect to the X-Y plane by sliding with respect to the first shaft 730. It should be mentioned that the embodiment may be applied to the previous embodiments depending on the needs. In other words, the shafts described in the previous embodiments can be provided with sliding slots formed thereon so that the pivoting component can move in the sliding slots.

In summary, in the lifting mechanism for desk described by the embodiments of the invention, at least one cross-arm assembly is disposed between two brackets, such that the relative distance between the two brackets can change along with the pivoting (shearing) action of the cross-arm assembly. Accordingly, when the cross-arm assembly generates a shearing action, the rotation of the shaft as well as the pivoting or sliding relation between the shaft and bracket enable the desk body to ascend/descend. The user can carry out work with either a sitting or standing posture while maintaining work productivity. Accordingly, it is possible to stay healthy and productive.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protection scope of the invention falls in the appended claims.

What is claimed is:

1. A lifting mechanism for desk, comprising:

a first bracket;

a second bracket;

at least one cross-arm assembly comprising at least three connecting ends respectively connected to the first bracket and the second bracket, the cross-arm assembly rotating about a first axis and changing a shear angle thereof so as to drive the first bracket and the second bracket to move to be closer or away from each other relatively along a second axis;

a first rail assembly comprising a first rail and a first sliding component, wherein the first rail is disposed on the first bracket and the first sliding component is slidably coupled to the first rail;

a second rail assembly comprising a second rail and a second sliding component, wherein the second rail is disposed on the second bracket and the second sliding component is slidably coupled to the second rail;

a positioning component comprising a pivoting end, a forcing end and a plurality of positioning slots between the pivoting end and the forcing end, the pivoting end pivoted to the first bracket or the second bracket such that the positioning slots are located adjacent to a sliding path of the first sliding component or a sliding path of the second sliding component; and a stirring component comprising a protruding rod movably extended to the forcing end, the stirring component pivoted to the first bracket or the second bracket;

wherein the first sliding component or the second sliding component further comprises an engaging flange to be engaged in one of the positioning slots, the stirring component adapted to be driven by an external force so that the protruding rod pushes the forcing end, such that the positioning component rotates with respect to the first bracket or the second bracket and enables the engaging flange to be engaged in one of the positioning slots.

2. The lifting mechanism for desk as claimed in claim 1, wherein the at least two connecting ends are slidably coupled to the first bracket, the second bracket, or the first bracket and the second bracket.

3. The lifting mechanism for desk as claimed in claim 1, where the at least one connecting end is only pivoted to the first bracket or the second bracket.

4. The lifting mechanism for desk as claimed in claim 1, further comprising:

a desk body assembled with the first bracket.

5. The lifting mechanism for desk as claimed in claim 1, wherein the cross-arm assembly comprises:

a first shaft comprising a first connecting end and a second connecting end, the first connecting end pivoted to the first shaft, the second connecting end slidably coupled to the second bracket along a third axis; and a second shaft comprising a third connecting end and a fourth connecting end, the third connecting end pivoted to the second bracket, the fourth connecting end slidably coupled to the first bracket along the third axis, wherein the first axis, the second axis and the third axis are orthogonal to one another.

6. The lifting mechanism for desk as claimed in claim 5, further comprising:

a pivoting component pivoted between the first shaft and the second shaft.

7. The lifting mechanism for desk as claimed in claim 6, wherein the first shaft further comprises a sliding slot, an extending direction thereof is consistent with an extending direction of the first shaft, a side of the pivoting component is pivoted to the second shaft, and the other side of the pivoting component is slidably and rotatably coupled to the sliding slot.

8. The lifting mechanism for desk as claimed in claim 6, wherein a length of an orthogonal projection of the first shaft and a length of an orthogonal projection of the second shaft on a plane are equivalent to each other, and the pivoting component is pivoted to a middle position of the first shaft and a middle position of the second shaft, wherein the first axis is along a normal vector of the plane.

9. The lifting mechanism for desk as claimed in claim 5, wherein the first rail is disposed on the first bracket along the third axis, the fourth connecting end is connected to the first sliding component, the second rail is disposed on the second bracket along the third axis, and the second connecting end is connected to the second sliding component.

10. The lifting mechanism for desk as claimed in claim 9, further comprising:

an elastic component abutted between the first bracket and the positioning component, or abutted between the second bracket and the positioning component, the elastic component constantly driving the positioning component and the engaging flange to be engaged with each other, or the elastic component constantly driving the positioning component and the engaging flange to be away from each other.

11. The lifting mechanism for desk as claimed in claim 5, further comprising:

a torsion spring disposed at a position where the first connecting end is pivoted to the first bracket and abutted between the first shaft and the first bracket, or disposed at a position where the third connecting end is pivoted to the second bracket and abutted between the second shaft and the second bracket so as to drive the first shaft to rotate with respect to the first bracket, or drive the second shaft to rotate with respect to the second bracket.

12. The lifting mechanism for desk as claimed in claim 1, wherein the cross-arm assembly comprises:

a third shaft comprising a fifth connecting end and a sixth connecting end, the fifth connecting end pivoted to the first bracket, the sixth connecting end slidably coupled to the second bracket along a third axis, wherein the first axis, the second axis and third axis are orthogonal to one another;

a fourth shaft comprising a seventh connecting end pivoted to the second bracket; and a pivoting component pivoted to the third shaft and the fourth shaft on the first axis.

13. The lifting mechanism for desk as claimed in claim 12, further comprising:

a third rail assembly comprising a third rail and a third sliding component, wherein the third rail is disposed on the second bracket along the third axis, the third sliding component is slidably coupled to the third rail, and the sixth connecting end is connected to the third sliding component.

14. The lifting mechanism for desk as claimed in claim 1, further comprising:

a pair of cross-arm assemblies respectively disposed between the first bracket and the second bracket; and at least one beam connected between the pair of cross-arm assemblies.

15. The lifting mechanism for desk as claimed in claim 1, wherein the cross-arm assembly comprises:

a first shaft comprising a first connecting end and a second connecting end, the first connecting end slidably connected to the first bracket along a third axis, the second connecting end slidably connected to the second bracket along the third axis; and a second shaft comprising a third connecting end and a fourth connecting end, the third connecting end pivoted to the second bracket, the fourth connecting end pivoted to the first bracket, wherein the first axis, the second axis and the third axis are orthogonal to one another.

16. The lifting mechanism for desk as claimed in claim 15, wherein the first bracket comprises a first edge and a second edge disposed on opposite sides of the cross-arm assembly, the second bracket comprises a third edge and a fourth edge disposed on the opposite sides of the cross-arm assembly, the first edge and the third edge are located on the same side of the cross-arm assembly, and the second edge and the fourth edge are located on the other same side of the cross-arm assembly, wherein the third connecting end is pivoted to the second edge and the third edge such that the first bracket and the second bracket move relatively along the third axis while moving relatively along the second axis.

17. The lifting mechanism for desk as claimed in claim 1, wherein the cross-arm assembly comprises:

a first shaft comprising a first connecting end and a second connecting end, the first connecting end slidably coupled to the first bracket along a third axis, the second connecting end slidably coupled to the second bracket along the third axis; and a second shaft comprising a third connecting end and a fourth connecting end, the third connecting end pivoted to the second bracket, the fourth connecting end slidably coupled to the first bracket along the third axis, wherein the first axis, the second axis and the third axis are orthogonal to one another.

18. The lifting mechanism for desk as claimed in claim 1, wherein the cross-arm assembly comprises:

a first shaft comprising a first connecting end and a second connecting end respectively slidably coupled to the first bracket and the second bracket along a third axis; and a second shaft comprising a third connecting end and a fourth connecting end respectively slidably coupled to the first bracket and the second bracket along the third axis, wherein the first axis, the second axis and the third axis are orthogonal to one another.

19. A lifting mechanism for desk, comprising:

a first bracket;

a second bracket;

a pair of cross-arm assemblies each comprising at least three connecting ends respectively connected to the first bracket and the second bracket, the cross-arm assembly rotating about a first axis and changing a shear angle thereof so as to drive the first bracket and the second bracket to move to be closer or away from each other relatively along a second axis, the pair of cross-arm assemblies respectively disposed between the first bracket and the second bracket;

at least one beam connected between the pair of cross-arm assemblies;

a first rail assembly comprising a first rail and a first sliding component, wherein the first rail is disposed on the first bracket and the first sliding component is slidably coupled to the first rail;

a second rail assembly comprising a second rail and a second sliding component, wherein the second rail is disposed on the second bracket and the second sliding component is slidably coupled to the second rail; and a positioning component comprising a pivoting end, a forcing end and a plurality of positioning slots between the pivoting end and the forcing end, the pivoting end pivoted to the first bracket or the second bracket such that the positioning slots are located adjacent to a sliding path of the first sliding component or a sliding path of the second sliding component;

wherein the first sliding component or the second sliding component further comprises an engaging flange to be engaged in one of the positioning slots.

* * * * *